US010818111B2

(12) United States Patent
Galula

(10) Patent No.: US 10,818,111 B2
(45) Date of Patent: Oct. 27, 2020

(54) TAMPER TUNE WATCHMAN

(71) Applicant: ARGUS CYBER SECURITY LTD., Tel Aviv (IL)

(72) Inventor: Yaron Galula, Kadima (IL)

(73) Assignee: Argus Cyber Security Ltd., Tel Aviv (IL)

( * ) Notice: Subject to any disclaimer, the term of this patent is extended or adjusted under 35 U.S.C. 154(b) by 323 days.

(21) Appl. No.: 15/728,512

(22) Filed: Oct. 10, 2017

(65) Prior Publication Data

US 2018/0122163 A1 May 3, 2018

Related U.S. Application Data

(60) Provisional application No. 62/414,744, filed on Oct. 30, 2016.

(51) Int. Cl.
*G07C 5/08* (2006.01)
*G07C 5/00* (2006.01)

(52) U.S. Cl.
CPC ..... *G07C 5/085* (2013.01); *G07C 5/008* (2013.01)

(58) Field of Classification Search
CPC ..... G07C 5/085; G07C 5/008
See application file for complete search history.

(56) References Cited

U.S. PATENT DOCUMENTS

| | | | | |
|---|---|---|---|---|
| 8,892,310 | B1 * | 11/2014 | Palmer | G07C 5/008 701/41 |
| 9,132,839 | B1 * | 9/2015 | Tan | B60W 50/00 |
| 9,248,819 | B1 * | 2/2016 | Tan | B62D 15/00 |
| 2007/0073944 | A1 * | 3/2007 | Gormley | B60R 16/0231 710/72 |
| 2007/0293124 | A1 * | 12/2007 | Smith | A63H 17/02 446/454 |
| 2008/0221776 | A1 * | 9/2008 | McClellan | B60R 16/0236 701/103 |
| 2017/0203766 | A1 * | 7/2017 | Prokhorov | B60W 40/09 |
| 2018/0004211 | A1 * | 1/2018 | Grimm | G01C 21/3407 |

OTHER PUBLICATIONS

Control Systems in Automobiles, retrieved on Aug. 31, 2016, http://web.iitd.ac.in/~achawla/courses.htm.

Jun Wang et al., Forming on Primary Control MAP Based on Fitting Surface with Scattered Data Point in Common Rail Diesel Engine, 2011 International Conference on Computer Science and Information Technology (ICCSIT 2011) IPCSIT vol. 51, pp. 515-520.

* cited by examiner

*Primary Examiner* — Mary Cheung
(74) *Attorney, Agent, or Firm* — A.C. Entis-IP Ltd.; Allan C. Entis

(57) ABSTRACT

A method of determining if a vehicle's performance has been modified, the method comprising: acquiring operational data comprised in communications signals transmitted over a vehicle's in-vehicle network during operation of the vehicle; processing the operational data to determine an operational profile for the vehicle that characterizes actual operation of the vehicle; and determining based on the operational profile if the vehicle performance has undergone modification.

20 Claims, 2 Drawing Sheets

70

IGNITION TIMING PHASE

| | 0 | 1000 | 2000 | 3000 | 4000 | 5000 | 6000 | 7000 | 8000 |
|---|---|---|---|---|---|---|---|---|---|
| 0 | 8 | 25 | 20 | 35 | 38 | 38 | 38 | 40 | 40 |
| 1 | 8 | 15 | 20 | 32 | 34 | 35 | 35 | 38 | 38 |
| 2 | 8 | 12 | 20 | 26 | 32 | 33 | 32 | 34 | 36 |
| 3 | 8 | 12 | 19 | 26 | 30 | 31 | 32 | 32 | 34 |
| 4 | 8 | 12 | 18 | 25 | 30 | 30 | 30 | 32 | 32 |
| 5 | 8 | 12 | 18 | 25 | 30 | 30 | 30 | 30 | 31 |
| 6 | 8 | 12 | 18 | 25 | 30 | 30 | 30 | 30 | 31 |
| 7 | 8 | 12 | 18 | 25 | 30 | 30 | 30 | 30 | 31 |

FIG.2

TAMPER TUNE WATCHMAN

RELATED APPLICATIONS

This application claims benefit under 35 U.S.C. 119(e) of U.S. Provisional Application 62/414,744 filed Oct. 30, 2016, the disclosure of which is incorporated herein by refer

FIELD

Embodiments of the disclosure relate to detecting performance modifications made to a vehicle.

BACKGROUND

Vehicle components that operate to control functions of modern automotive vehicles are controlled by electronic control units, (ECUs), which typically comprise a processor and a suitable transducer configured to generate electronic control signals that control functions of the components. The ECUs communicate with each other and with sensors and/or actuators that generate signals relevant to operation of the ECUs and components that the ECUs control via an in-vehicle communication network to cooperate in controlling the vehicle in response to driver actions and vehicle driving conditions. The ECUs are preprogrammed at the factory with a factory set of executable instructions and data, often conventionally referred to as a "map", that govern operation of the ECUs and thereby the components that they control.

By way of example, an ECU that controls performance of a spark ignition internal combustion engine (ICE) of a vehicle may be configured to control engine ignition timing during an engine cycle responsive to values of variables relevant to ignition timing. The relevant variables may include by way of example, fuel delivery rates, settings of a waste gate of a turbocharger, air and engine temperatures, engine speed, and engine load. Values for the relevant variables and corresponding engine ignition times may be stored in a look up table (LUT) in a memory of the ECU. At any given time during operation of the vehicle, the ECU receives signals from various sensors in the vehicle that provide the ECU with values for the relevant variables. The ECU may be programmed to access and retrieve from the LUT an ignition time corresponding to the received values and use the retrieved ignition time for timing ignition of the engine during an engine cycle.

Vehicle manufacturers typically determine values for a LUT that governs performance of a vehicle component, such as the vehicle engine, to provide a desired level of vehicle reliability in anticipation that the vehicle may be used under different conditions of climate and terrain, exhaust pollution restrictions, fuel quality, and that owners may not adhere to conditions of vehicle warrantees. As result, vehicle manufacturers typically provide ECUs for controlling vehicle components with LUTs that comprise "common denominator", "compromise", values for ECUs that have relatively large tolerances. The values and relatively large tolerances are configured to accommodate expected variations in vehicle use and owner behavior, and are generally not configured to provide maximum vehicle performance. In addition, automotive manufactures may configure a same automotive component differently for use in different vehicles. For example, different vehicle models manufactured by a same manufacture may share a same make engine. However, for commercial and marketing reasons the ECUs that control the engines in a vehicle model marketed by the manufacture as a sports vehicle may control the engines responsive to LUTs that tune the engines for higher performance than ECUs that control the same make engines in models marketed by the manufacture as more sedate, family vehicles.

As a result, cottage and commercial industries have developed that engage in reprogramming, often referred to as "remapping" or "chip tuning", ECUs that operate to control vehicle components to provide vehicle owners with desired, generally enhanced performance of their vehicles.

SUMMARY

An aspect of an embodiment of the disclosure relates to providing apparatus, hereinafter also referred to as a "Tuning Watchman" for determining whether a vehicle ECU configured to control a component of a vehicle has been remapped to modify performance of the component, and thereby performance of the vehicle. In an embodiment of the disclosure a Tuning Watchman, comprises a communications module configured to be coupled to an in-vehicle communication network of a vehicle, and comprises and/or has access to a processor. The communications module is configured to forward to the processor data comprised in communications signals transmitted over the in-vehicle network that is relevant to operation of the vehicle, ECUs in the vehicle, vehicle components that the ECUs controls, and/or sensors that monitor vehicle performance. The processor may be configured to process the operational data it receives from the communications module to determine if vehicle performance has been modified for example by remapping of an ECU or ECUs, by addition of a component coupled to the in-vehicle communication network, or structural change to the vehicle.

Operational data may include data comprised in signals that an ECU in the vehicle generates and/or data comprised in signals that an ECU receives, for example from various vehicle sensors or non-standard components added to the vehicle. Signals and data that an ECU receives may be referred to as input signals and input data respectively, and signals and data that the ECU generates for transmission may be referred to as output signals and output data respectively. ECU operational signals may refer generically to ECU input and/or ECU output signals. Remapping an ECU to enhance operation of a vehicle component may be referred to as tuning the component. Remapping an ECU to lower performance of a vehicle component may be referred to as "detuning" the component.

In an embodiment of the disclosure the processor stores operational data, which may comprise storing a function of operational data, it receives from the communications module in a database to acquire an operational profile for the vehicle. The operational profile provides data for determining and analyzing actual functioning of an ECU or ECUs in the vehicle during operation of the vehicle. The processor may compare the actual functioning indicated by the vehicle operational profile with functioning of the vehicle expected from factory settings to determine if an ECU or other vehicle component has been modified.

In an embodiment, the processor processes operational data it receives to create a "shadow" LUT for an ECU for use in determining whether the ECU has been remapped. A shadow LUT in accordance with an embodiment reflects how the ECU actually operates during vehicle operation. The processor may compare the shadow LUT with a factory LUT to determine if the ECU has been remapped.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF FIGURES

Non-limiting examples of embodiments of the disclosure are described below with reference to figures attached hereto that are listed following this paragraph. Identical features that appear in more than one figure are generally labeled with a same label in all the figures in which they appear. A label labeling an icon representing a given feature of an embodiment of the disclosure in a figure may be used to reference the given feature. Dimensions of features shown in the figures are chosen for convenience and clarity of presentation and are not necessarily shown to scale.

FIG. 2 shows a schematic simplified LUT comprising data useable by an ECU configured to control a vehicle spark ignition ICE.

DETAILED DESCRIPTION

Figure 1:
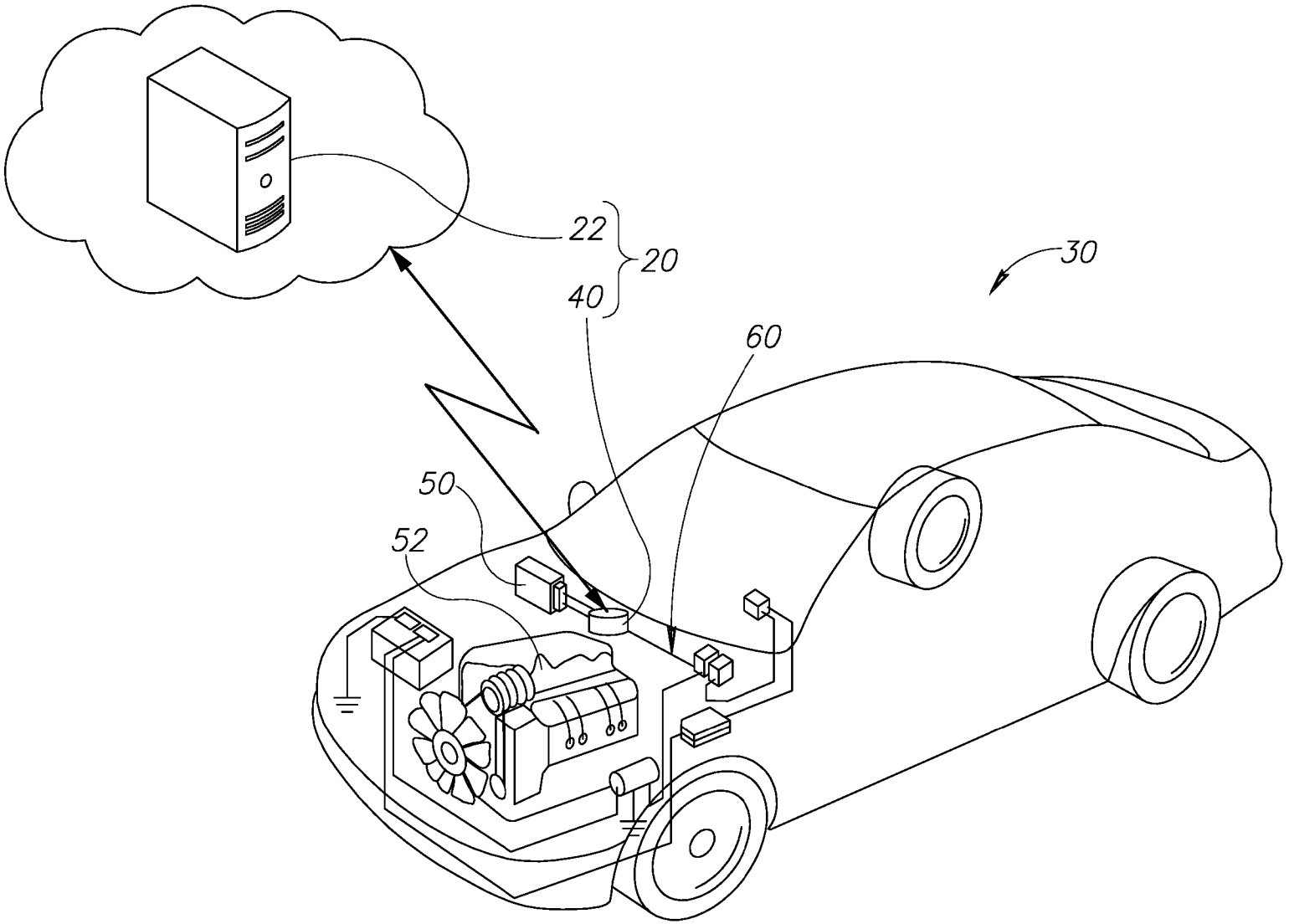
FIG. 1 schematically shows a Tuning Watchman comprising a communications module coupled to an in-vehicle communications network and an optionally cloud based processor in accordance with an embodiment of the disclosure.

In the discussion, unless otherwise stated, adjectives such as "substantially" and "about" modifying a condition or relationship characteristic of a feature or features of an embodiment of the disclosure, are understood to mean that the condition or characteristic is defined to within tolerances that are acceptable for operation of the embodiment for an application for which the embodiment is intended. Wherever a general term in the disclosure is illustrated by reference to an example instance or a list of example instances, the instance or instances referred to, are by way of non-limiting example instances of the general term, and the general term is not intended to be limited to the specific example instance or instances referred to. Unless otherwise indicated, the word "or" in the description and claims is considered to be the inclusive "or" rather than the exclusive or, and indicates at least one of, or any combination of more than one of items it conjoins.

FIG. 1 schematically shows a Tuning Watchman 20 comprising an, optionally, cloud based Tuning Watchman processing hub 22 and a communications module 40 coupled to a portion of an in vehicle network 60 of a vehicle 30. Processing hub 22 may comprise any electronic and/or optical processing and/or control circuitry, to provide and enable functionalities that the processing hub may require to support its operation in embodiments that are described below and embodiments similar to the described embodiments. By way of example, processing hub 22 may comprise any one, or any combination of more than one of, a microprocessor, an application specific circuit (ASIC), field programmable array (FPGA) and/or system on a chip (SOC). Processing hub 22 may have a memory (not shown) comprising any electronic and/or optical circuitry suitable for storing data and/or computer executable instructions and may, by way of example, comprise any one or any combination of more than one of a flash memory, random access memory (RAM), read only memory (ROM), and/or erasable programmable read-only memory (EPROM). Similarly, communications module 40 may comprises any electronic and/or optical, processing, control circuitry, and/or memory circuitry advantageous for supporting functionalities of the communications module. Processing hub 22 and communications module 40 may comprise any or any combination of various mobile communication interfaces to enable the processing and communications hub to communicate directly and/or indirectly (for example via an on board diagnostics (OBD) port or vehicle telematics unit) with each other over any mobile communication network and/or the internet.

Vehicle 30 comprises various ECUs that communicate with each other and with sensors in the vehicle via an in-vehicle network 60 to cooperate in controlling and monitoring functioning of components and systems of vehicle 30. FIG. 1 schematically shows an ECU 50 of the many ECUs in a vehicle such as vehicle 30. By way of example, ECU 50 is an ECU that controls operation of a spark ignition ICE engine 52, of the vehicle. ECU 50 comprises a processor (not shown) and memory (not shown) having executable instructions and data that configure the ECU to control operation of engine 52 responsive to data in input signals that the ECU receives via in-vehicle network 60. A portion of the data that ECU 50 uses for controlling engine 52 is located in a LUT stored in the ECU memory.

FIG. 2 shows a simulated very simplified factory set LUT 70 that ECU 50 may comprise and use to determine when to fire spark plugs in engine 52 to ignite gases in a combustion chamber of the engine during a piston cycle of a piston in the combustion chamber. LUT 70 provides an "ignition map" of values for angular phase by which sparking of the chamber should lead angular phase of the piston cycle as a function of RPM (revolutions per minute) of a crankshaft to which the piston is coupled and engine load. Crank shaft RPM is shown along a top row of the LUT 70 and engine load in arbitrary units is shown along a left most column of the LUT. An ignition phase for a given RPM and engine load is provided in a cell of LUT 70 at an intersection of a column in the LUT labeled by the given RPM and a row of the LUT labeled by the given load. Phase values are referenced to a 0° phase of the piston cycle corresponding to the piston being at top dead center (TDC) of the chamber. ECU 50 may determine an ignition phase by determining RPM and engine load and "looking up" a phase in LUT 70 in the cell at the intersection of the RPM column and load row.

For example, if the ECU determines that engine RPM is equal to 3000 and load is equal to 3, ECU 50 may determine from access to LUT 70 to trigger ignition of a chamber of engine 52 at a phase of 26°. ECU 50 may be programmed to interpolate ignition phase for values of RPM and/or load that do not coincide with an RPM and/or load listed in LUT. ECU 50 may determine RPM based on input signals that the ECU receives from a crankshaft position sensor (not shown) and engine load based on input signals that the ECU receives from an airflow meter or suction pressure sensor (not shown).

In order to tune or detune engine 52 from factory settings of LUT 70 shown in FIG. 2 an owner of vehicle 30 may remap ECU 50 by modifying values in cells of LUT 70. For example the owner may tune the engine to produce greater power for a given RPM and load by advancing ignition timing by increasing ignition phase relative to that shown in LUT 70 for the given RPM and load. To detune engine 52 to generate less power for the given RPM and load, ignition may be retarded by decreasing phase lead for the given RPM and load relative to that shown in LUT 70.

In an embodiment of the disclosure, to determine if ECU 50 has been remapped to tune or detune engine 52, communication module 40 may monitor input and output signals communicated respectively to and/or by ECU 50 and transmit to processing hub 22 operational data comprised in the communications that characterize operation of ECU 50. The operational data may for example comprise values for RPM, and/or engine load that ECU 50 uses to determine ignition phase, and the ignition phase that the ECU determines responsive to the RPM and load values. Additionally or alternatively, the operational data may comprises data in signals that ECU 50 receives and uses to determine RPM, engine load, and/or sensor data that indicates actual ignition phase.

Optionally, communications module 40 may be configured to mirror to processing hub 22 operational signals that are transmitted and/or received by ECU 50 to forward operational data to the processing hub. In an embodiment communications module 40 may be configured to inspect operational communications relevant to operation of ECU 50 and extract operational data from the messages to transmit operational data to processing hub 22.

In an embodiment, processing hub 22 accumulates operational data it receives from communications module 40 for ECU 50 in a memory to determine an operational profile of the ECU that exhibits actual relationships between the ECU input signals, between the ECU output signals and/or between the ECU input and output signals and data they contain that are exhibited during operation of the vehicle. Processing hub 22 may configure the operational profile as a shadow LUT having RPM columns and engine load rows in format similar to that of LUT 70 but populated with cell values determined responsive to actual operational data that the processing hub receives from communication module 40. In an embodiment processing hub 22 determines a value for a given cell in the shadow LUT for which processing hub 22 has received operational data for ECU 50, to be equal to an average of values received for the RPM and engine load associated with the given cell. Processing hub 22 may determine if ECU 50 has been remapped by comparing the shadow LUT with a copy of factory set LUT 70 stored in a memory that the processing hub comprises or a memory to which the processing hub has access.

In an embodiment, processing hub 22 may be configured to receive operational data from a plurality of vehicles and process the data to generate operational profiles for the vehicles. Optionally, the operational profiles comprise operational profiles for one or more ECUs in the vehicles. To determine if a given ECU of the one or more ECUs has been remapped, processing center 22 may compare the given ECU's operational profile to operational profiles of other ECUs to determine if the given ECU's operational profile is an outlier and if it is an outlier determine that the ECU has been remapped.

By way of example, processing hub 22 may determine a shadow LUT for each ECU of a plurality of ECUs. For a given type of ECU, such as for example an engine ECU of a given make vehicle, processing hub 22 may determine a normative LUT in which each given cell is associated with a normative cell value that is equal to an average of the values associated with cells homologous with the given cell from the shadow LUTs for the given type ECU. Each normative cell value may also be associated with a variance of the normative value. For a shadow LUT of a given ECU processing hub 22 may perform a statistical test to determine a probability that the shadow LUT is the same as the normative LUT to determine if the given ECU has been remapped.

It is noted that in the above description an ECU is described as operating in accordance with a simplified LUT and that cell "output" values in the LUT are functions of two variables. An ECU may operate in accordance with LUTs or families of LUTs in which cell values are functions of more or less than two variables and in which a cell of the LUT comprises a set of output values. An ECU may also operate in accordance with functional relationships having forms different from LUTs and may for example operate in accordance with parametric equations. In an embodiment processing hub 22 may determine operational profiles for an ECU comprising corresponding forms of functional relationships to determine if an ECU has been remapped.

It is noted that the above description refers to detecting ECU remapping. However, practice of an embodiment of the disclosure is not limited to detecting modifications to vehicle performance resulting from ECU remapping. For example, a vehicle may be tuned or detuned by adding a component or components that connects between an ECU and sensors that provide input signals to the ECU to adjust signals that the sensors provide the ECU. The component, which may be referred to as a "piggy back" component, may for example adjust modify signals input to an engine control ECU to change ignition timing and engine power output. A Tuning Watchman in accordance with an embodiment of the disclosure, such as Tuning Watchman 20, may be configured to recognize "piggy back' tuning by processing operational data transmitted over the in-vehicle communications network.

Vehicle performance may also be modified by making structural changes to the vehicle for example, by adding spoilers to the body or changing tire sizes. A Tuning Watchman in accordance with an embodiment of the disclosure, may operate to detect such changes responsive to operational profiles that the Tuning Watchman acquires.

There is therefore provide in accordance with an embodiment of the disclosure a method of determining if a vehicle performance has been modified, the method comprising: acquiring operational data comprised in communications signals transmitted over the vehicle's in-vehicle network that is relevant to operation of the vehicle; processing the operational data to determine an operational profile for the vehicle; and comparing the operational profile to an expected operational profile to determine if the vehicle performance has been modified.

In the description and claims of the present application, each of the verbs, "comprise" "include" and "have", and conjugates thereof, are used to indicate that the object or objects of the verb are not necessarily a complete listing of components, elements or parts of the subject or subjects of the verb. And unless otherwise stated, adjectives such as "substantially" and "about" modifying a condition or relationship characteristic of a feature or features of an embodiment of the disclosure, are understood to mean that the condition or characteristic is defined to within tolerances that are acceptable for operation of the embodiment for an application for which it is intended. In addition the word "or" is considered to be the inclusive "or" rather than the exclusive or, and indicates at least one of, or any combination of items it conjoins.

Descriptions of embodiments of the invention in the present application are provided by way of example and are not intended to limit the scope of the invention. The described embodiments comprise different features, not all of which are required in all embodiments. Some embodiments utilize only some of the features or possible combinations of the features. Variations of embodiments of the invention that are described, and embodiments comprising different combinations of features noted in the described embodiments, will occur to persons of the art. The scope of the invention is limited only by the claims.

The invention claimed is:

1. A method of determining if a vehicle's performance has been modified, the method comprising:

acquiring operational data comprised in communications signals transmitted over a vehicle's in-vehicle network during operation of the vehicle;

processing the operational data to determine an actual operational profile for the vehicle that characterizes actual operation of the vehicle; and determining based on the determined actual operational profile if a modification has been made to a preceding manufacturer operational profile of the vehicle that is expected to be the actual operational profile.

2. The method according to claim 1 wherein determining based on the operational profile comprises comparing the actual operational profile with the expected operational profile.

3. The method according to claim 2 wherein the operational profile data comprises data that characterizes actual operation of at least one electronic control (ECU) unit comprised in the vehicle and the expected operational data comprises data characterizing expected operation of the at least one ECU.

4. The method according to claim 3 wherein the expected operational profile comprises data having values that are functions of values acquired for operational profiles of a plurality of vehicles.

5. The method according to claim 4 wherein the values in the expected operational profile data comprise values that are functions of one or more variables.

6. The method according to claim 4 wherein the expected operational profile data comprises averages of values acquired for operational profiles of the plurality of vehicles.

7. The method according to claim 3 wherein the modification comprises a remapping of an ECU of the at least one ECU.

8. The method according to claim 2 wherein the expected operational profile comprises a factory set of data that are intended to govern operation of the vehicle.

9. The method according to claim 1 wherein the expected operational profile comprises a look-up-table (LUT) and values in the expected operational profile are arrayed in cells of the LUT.

10. The method according to claim 1 wherein the determined actual operational profile comprises a LUT and values in the operational profile are arrayed in cells of the LUT.

11. The method according to claim 1 wherein the modification comprises a structural change to the vehicle.

12. The method according to claim 1 wherein the modification comprises addition of a piggy back component to the vehicle.

13. Apparatus for determining if a vehicle's performance has been modified, the apparatus comprising:

a processor;

a communications module configured to be coupled to an in-vehicle communication network of a vehicle and forward to the processor operational data comprised in communications signals transmitted over the in-vehicle network relevant to operation of the vehicle; wherein the processor is configured to:

process the operational data to determine an actual operational profile for the vehicle that characterizes actual operation of the vehicle; and determine based on the determined actual operational profile if a modification has been made to a preceding manufacturer operational profile of the vehicle that is expected to be the actual operational profile.

14. The apparatus according to claim 13 wherein the modification comprises a remapping of an ECU of the at least one ECU.

15. The apparatus according to claim 13 wherein the modification comprises a structural change to the vehicle.

16. The apparatus according to claim 13 wherein the modification comprises addition of a piggy back component to the vehicle.

17. A system for determining if a vehicle's performance has been modified, the system comprising:

a processing hub;

a communications module coupled to an in-vehicle communication network of each vehicle of at least one vehicle configured to forward to the processing hub operational data comprised in communications signals transmitted over the in-vehicle network relevant to operation of the vehicle; wherein the processing hub is configured to:

process the operational data received from a given vehicle of the at least one vehicle to determine an actual operational profile for the given vehicle that characterizes actual operation of the given vehicle; and determine based on the determined actual operational profile if a modification has been made to a preceding manufacturer operational profile of the vehicle that is expected to be the actual operational profile.

18. The system according to claim 17 wherein the at least one vehicle comprises a plurality of vehicles.

19. The system according to claim 18 wherein and the processing hub is configured to process operational data received from at least a portion of the plurality of vehicles to determine a normative operational profile for the at least a portion of the plurality of vehicles and determine based on the normative operational profile if the given vehicle performance has undergone modification.

20. The system according to claim 17 wherein the processing hub is cloud based.

* * * * *